US008371995B2

(12) United States Patent
Crawford

(10) Patent No.: US 8,371,995 B2
(45) Date of Patent: Feb. 12, 2013

(54) SPEED BAG APPARATUS

(76) Inventor: Jeffrey Crawford, Huntington Beach, CA (US)

( * ) Notice: Subject to any disclaimer, the term of this patent is extended or adjusted under 35 U.S.C. 154(b) by 153 days.

(21) Appl. No.: 13/047,796

(22) Filed: Mar. 15, 2011

(65) Prior Publication Data

US 2012/0238415 A1 Sep. 20, 2012

(51) Int. Cl.
*A63B 21/00* (2006.01)

(52) U.S. Cl. ..... 482/83; 482/87; 482/90

(58) Field of Classification Search ..... 482/83–90
See application file for complete search history.

(56) References Cited

U.S. PATENT DOCUMENTS 5,484,364 A 1/1996 Boring
5,788,612 A * 8/1998 Rennick ..... 482/83
5,800,320 A 9/1998 Ray
5,803,877 A * 9/1998 Franey ..... 482/83
5,921,895 A * 7/1999 Lynch et al. ..... 482/83
5,944,639 A 8/1999 Ray
6,464,622 B1 * 10/2002 Clark ..... 482/84
6,623,408 B1 9/2003 Kyle

OTHER PUBLICATIONS

Lonsdale website page of Lonsdale L48 Super Pro Adjustable Speed Ball Platform as viewed on Aug. 6, 2010.

* cited by examiner

*Primary Examiner* — Jerome W Donnelly
(74) *Attorney, Agent, or Firm* — Craig McLaughlin, Esq.

(57) ABSTRACT

The present invention is an improved speed bag apparatus having a post 15 connected at its lower end 16 to a speed bag platform 50 by a vibration dampener 40. The vibration dampener rigidizes the connection between the post and the platform. The invention also includes a post collar 20 to guide and capture the post therein. The post is attached to a mounting apparatus which includes support members 31, 32, and 33 and a wall plate 30. The post collar also includes a pivoting clamp arm 60 which may be actuated by a turnable shaft 70 to grip the post as desired.

20 Claims, 7 Drawing Sheets

SPEED BAG APPARATUS

FEDERALLY SPONSORED RESEARCH

Not applicable

SEQUENCE LISTING OR PROGRAM

Not applicable

BACKGROUND OF THE INVENTION

1. Field of Invention

This invention relates to an improved adjustable speed bag apparatus that reduces unwanted vibration during use.

2. Prior Art

In the sport of boxing, speed bags (or "striking bags" as they are often referred to in Europe) are routinely used in training to improve a boxer's hand speed, timing and reaction to punches. Highly skilled boxers can strike a speed bag with very rapid successions of punches and with ferocious intensity. Mechanisms from which to suspend a speed bag are varied, but usually include a ring connected to a swivel from which the bag is suspended to allow the bag to freely swing and rotate when punched. The swivel is often attached to the underside of a platform made of wood. When the bag is sufficiently punched, it swings upwardly until it is stopped by slamming into the underside of the platform, then bouncing off of it and returning toward the boxer to be hit again or to swing through and collide again with the another area of the platform. Violent punches and impact of a speed bag onto the platform, however, can cause the speed bag apparatus to vibrate. Fast and heavy work on a speed bag can produce unwanted vibration that may result in aberrant motion of the bag and undesirable disturbance of the boxer's timing trying to hit it.

The problem of vibration during use of a speed bag apparatus is not new. For example, in the prior art, one of the express objects of U.S. Pat. No. 5,484,364 to Boring, was "to provide an apparatus for supporting a striking bag that is durable and able to withstand vibration and impact." However, the '364 patent discloses a cumbersome vertically-adjustable pair of platform support brackets extending from the upper portion of an inner slideable assembly within a wall-mounted stationary frame. Adjusting the height of the platform requires loosening a pair of hand knobs to allow movement of the inner assembly from the fixed wall-mounted frame. Once loosened, the inner assembly may be physically raised or lowered with its attached brackets and platform into a desired ratchet tab position and, to secure its position, the knobs are retightened. While the knobs, when tightened, may secure the bottom of the slideable assembly to the wall-mounted frame, the security of the upper portion of the slideable assembly appears to rely on the interaction of the metal-on-metal ratchet tabs. It can thus be envisioned that when in use the device would be noisy and transmit vibration throughout the apparatus.

U.S. Pat. No. 5,800,320 to Ray discloses a hanging bag apparatus having a vertical main frame unit and a pair of vertical, symmetrical, cylindrically-shaped tubes secured to three horizontally extending wall mounting brackets. According to the '320 patent, the hanging target is suspended from a striking bag platform attached to a movable striking bag carriage assembly that moves along the outside of the vertical tubes. The entire carriage assembly rides up and down along the tubes on four nylon roller bearing assemblies and is counterbalanced with two 40 pound weights which are enclosed within the tubes and are supported by rollers and cables. Securement of the carriage assembly to the pair of tubes appears to depend upon four sets of U-shaped rods each surrounded by a grouping of nylon roller bearings, the upper pair of bearings being sufficiently loose to permit travel of the carriage relative to the tubes when the lower pair is loosened. Fixing the desired position of the carriage is relegated to a pair of bearing pads at the bottom of the carriage assembly actuated by turnable hand knobs while the upper bearing surfaces only slightly engage the peripheral edges of the tubes. [Col. 6, ins. 60-67] Nylon, of course, is somewhat malleable as a material and is subject to wear which can result in additional insecurity of the upper portion of the carriage and increase the tendency of the entire carriage and platform to vibrate during use. The material of the bearing pads may also be subject to wear and the cylindrical tubes may be deformed by them.

Vibration of the device disclosed in the '320 patent was apparently a drawback. In a continuation-in-part of the '320 patent, U.S. Pat. No. 5,944,639 to Ray, a similar speed bag support apparatus is disclosed. According to the '639 patent, however, the weights include a cap or plastic coating at their ends to reduce noise and vibration from inside the cylindrical tubes. [Col. 6, Ins. 37-43] While complementary shapes of the lower carriage bearing pads are disclosed, both Ray patents continue to suffer from the same loosely-contacting nylon upper roller bearing surfaces, wearable bearing pads, and deformable character of the vertical tubes. [Col, 2, Ins, 3-5; Col. 7, Ins, 15-29]

U.S. Pat. No. 6,623,408 to Kyle discloses a wall-mountable speed bag apparatus having a retractable platform for storing the device like a Murphy bed when not in use. When use is desired the speed bag platform is lowered by a pair of cables which may be hand cranked from about an axle. Once lowered, there appears to be no mechanism to prevent the platform from moving or vibrating in at least the return direction during use.

In sum, all the referenced prior art speed bag apparatuses suffer from being susceptible to unwanted vibration during use.

OBJECTS AND ADVANTAGES

One object of the instant invention is to provide a simple and convenient speed bag apparatus that is configured to reduce vibration during use.

Another object of the invention is to provide such a device that enables a user to easily adjust and maintain the height position of the speed bag.

SUMMARY

The invention discloses an improved speed bag apparatus that incorporates a vibration dampener which rigidizes the relationship between the speed bag striking platform and the post from which the platform is suspended. The post is captured by a post collar attached to a mounting apparatus. The post collar includes a clamp which may be actuated to selectively grip the post and position the platform as desired.

DETAILED DESCRIPTION OF PREFERRED EMBODIMENTS

Figure 1:
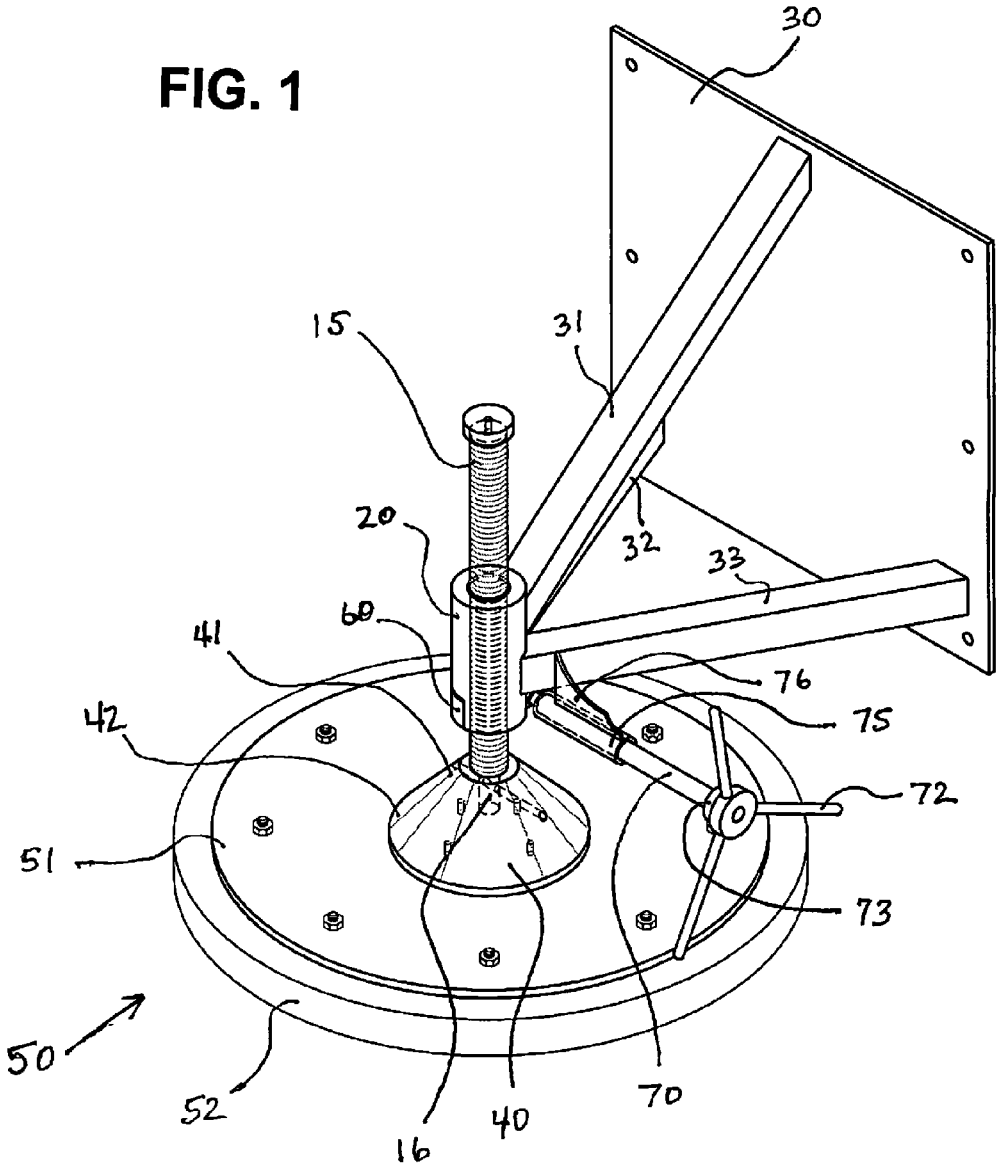
FIG. 1 is a perspective view of a preferred embodiment of the present invention.
Figure 3:
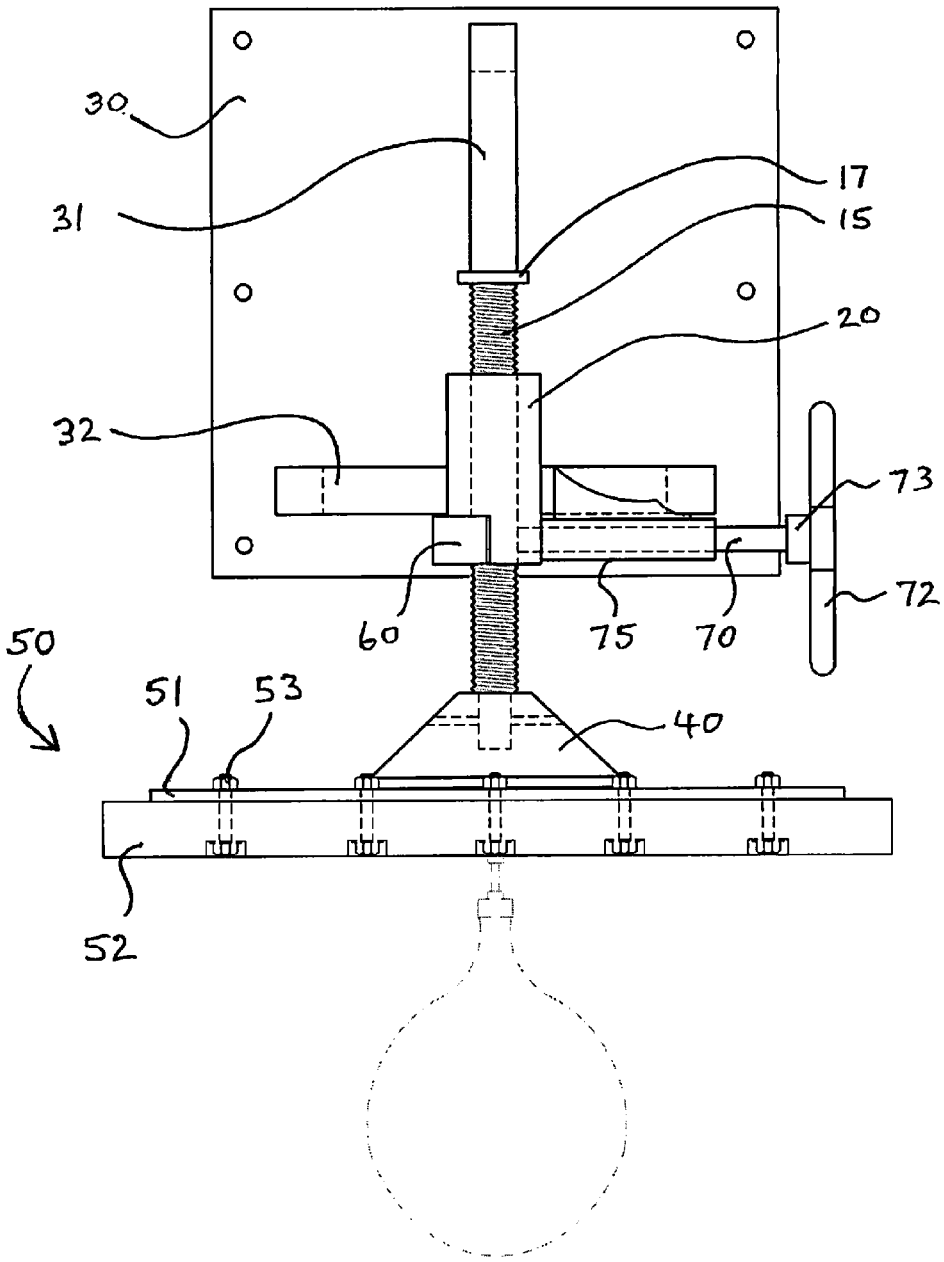
FIG. 3 is a front view of a preferred embodiment of the present invention.

A preferred embodiment of the improved speed bag apparatus of the present invention is illustrated in FIG. 1 (perspective view) and FIG. 3 (front view). The embodiment illustrated in FIG. 1 shows a post 15 captured by a post collar 20 that is attached to a mounting apparatus comprising a wall plate 30 and three support members 31, 32 and 33 which connect the wall plate to the post collar. Optionally, the mounting apparatus could be comprised, for example, of a single support member attached to the post collar and configured for attachment to a ceiling, a wall, or sturdy stand as desired. The post collar 20 also includes a pivoting clamp arm 60 which may be actuated to grip the post and maintain it in a fixed position as desired by a turnable shaft 70 having a hub 72 and a handle 73. In the preferred embodiment, the shaft is captured and stabilized by a shaft collar 75 which is attached to a support member 33 by a brace 76.

The speed bag apparatus also includes a vibration dampener 40 and a two-piece platform 50 comprising a dampener plate 51 and wooden contact board 52. The post 15 and the interior of the post collar 20 are preferably mating threaded to allow for rotational and vertical travel of the post within the post collar 20. Preferably, a post cap 17 is provided to inhibit the post from dropping out of the post collar.

The post 15 includes a lower end 16 which is seated in the vibration dampener 40. The vibration dampener has a neck 41 and a base 42, the base being broader than the neck. The vibration dampener is preferably comprised of solid aluminum and is preferably conical in shape. Unless otherwise indicated herein the balance of the apparatus is preferably made of steel. The base 42 of the vibration dampener 40 is connected to the upper surface of the dampener plate 51 preferably by threaded fasteners that enter threaded fastener holes in base 42 from the underside of the dampener plate 51 before the wooden contact board 52 is attached to the dampener plate by machine bolts.

Figure 2:
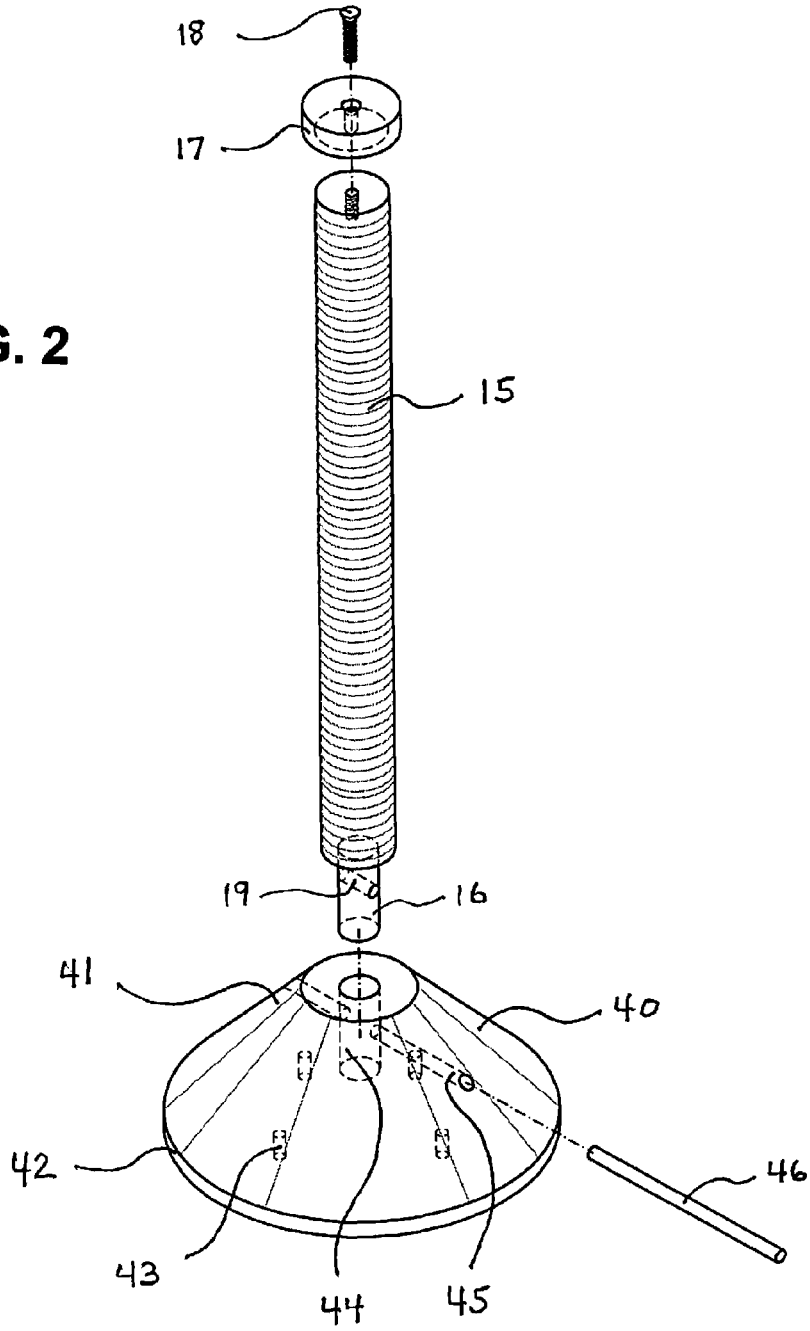
FIG. 2 is an exploded view of the post and vibration dampener assembly of a preferred embodiment of the present invention.

In FIG. 2, the post 15 and vibration dampener 40 of a preferred embodiment are shown. The post is shown with the lower end 16 and a post cap 17. The cap may be fastened to the post by a screw 18 driven into a pre-threaded hole in the top of the post. In the preferred embodiment, the post is 16 inches long. Except for the smooth lower end, the post is 1.75 inches in diameter and is threaded with 5 pitch threads at $^{70}/_{100,000}$ inch depth. Optionally, the configuration of the post may differ, such as for example, having a greater or shorter length to accommodate a different range in height adjustment of the platform.

The neck 41 of the vibration dampener 40 has a post seat 44 shaped to snuggably receive the lower end 16 of the post 15, the lower end having a pin bore 19, and the neck having a corresponding pin hole 45, so that when aligned, the pin hole and pin bore accommodate a locking pin 46 securing the post to the vibration dampener. Optionally, the lower end and the post seat may be threaded. The base 42 of the vibration dampener includes threaded fastener holes 43 which receive threaded fasteners securing the dampener plate to the vibration dampener.

FIG. 3 shows features of a preferred embodiment of the invention including a platform 50 comprising a dampener plate 51 and a wooden contact board 52, the board being configured to receive a speed bag swivel mechanism, as is known in the art, for attaching a speed bag to a contact platform. A flat surface is usually all that is required to secure a speed bag attachment mechanism which often includes a swivel having a bracket for attachment. In the preferred embodiment, the dampener plate 51 is 0.38 inch thick and is 22 inches in diameter. The board 52 is secured to the dampener plate by threaded machine bolts 53, the screws of which enter from the undersurface of the board and into accommodating bolt holes in the dampener plate.

Optionally, the platform may be composed of one piece such as only a board or only a plate and may be partially or entirety made of wood, metal or other rigid material, the upper surface of which may be attached to the base of the vibration dampener, the underside being configured to receive a speed bag attachment mechanism, as is known in the art, for attaching a speed bag.

Figure 4:
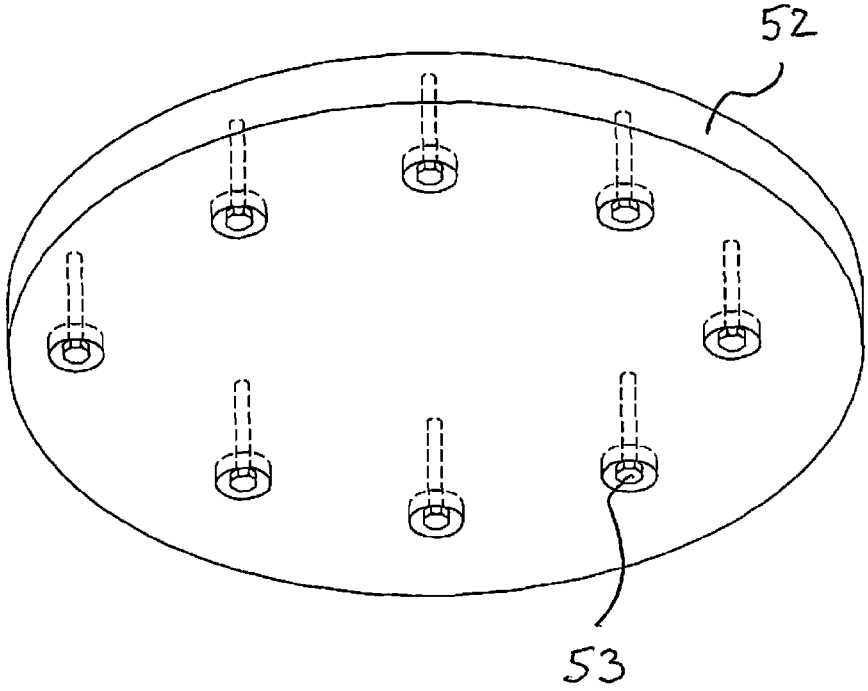
FIG. 4 is a perspective view of a wooden contact board of a preferred embodiment of the present invention.

In FIG. 4, the wooden contact board 52 is shown with the heads of the machine bolts 53 countersunk into the board as is preferred. The board of the preferred embodiment is 2.0 inches thick and 25 inches in diameter and is made of poplar.

Referring back to FIG. 3, once the vibration dampener 40 is secured to the post 15 and to the platform 50, this sub-assembly operates as a rigidized unit. So assembled, the vertical position of the platform may be adjusted by raising or lowering the post 15 within the post collar 20. In the preferred embodiment, which includes a threaded post 15 and matingly threaded post collar 20, this is accomplished by turning the platform about the vertical axis of the post. Alternatively, the post and the post collar may be unthreaded as desired allowing movement of the post up or down within the post collar without requiring rotation of the post.

A second sub-assembly is formed by the post collar 20 together with the mounting apparatus comprised of support members and the wall plate 30. To secure the vertical position of the platform relative to the post collar 20, the post collar includes a pivoting clamp arm 60 which may be actuated to grip the post 15 as desired by turning the shaft 70. Interaction of the clamp arm, the post collar and the shaft is shown in more detail in FIG. 5, FIG. 6 and FIG. 7 and as described below.

Figure 5:
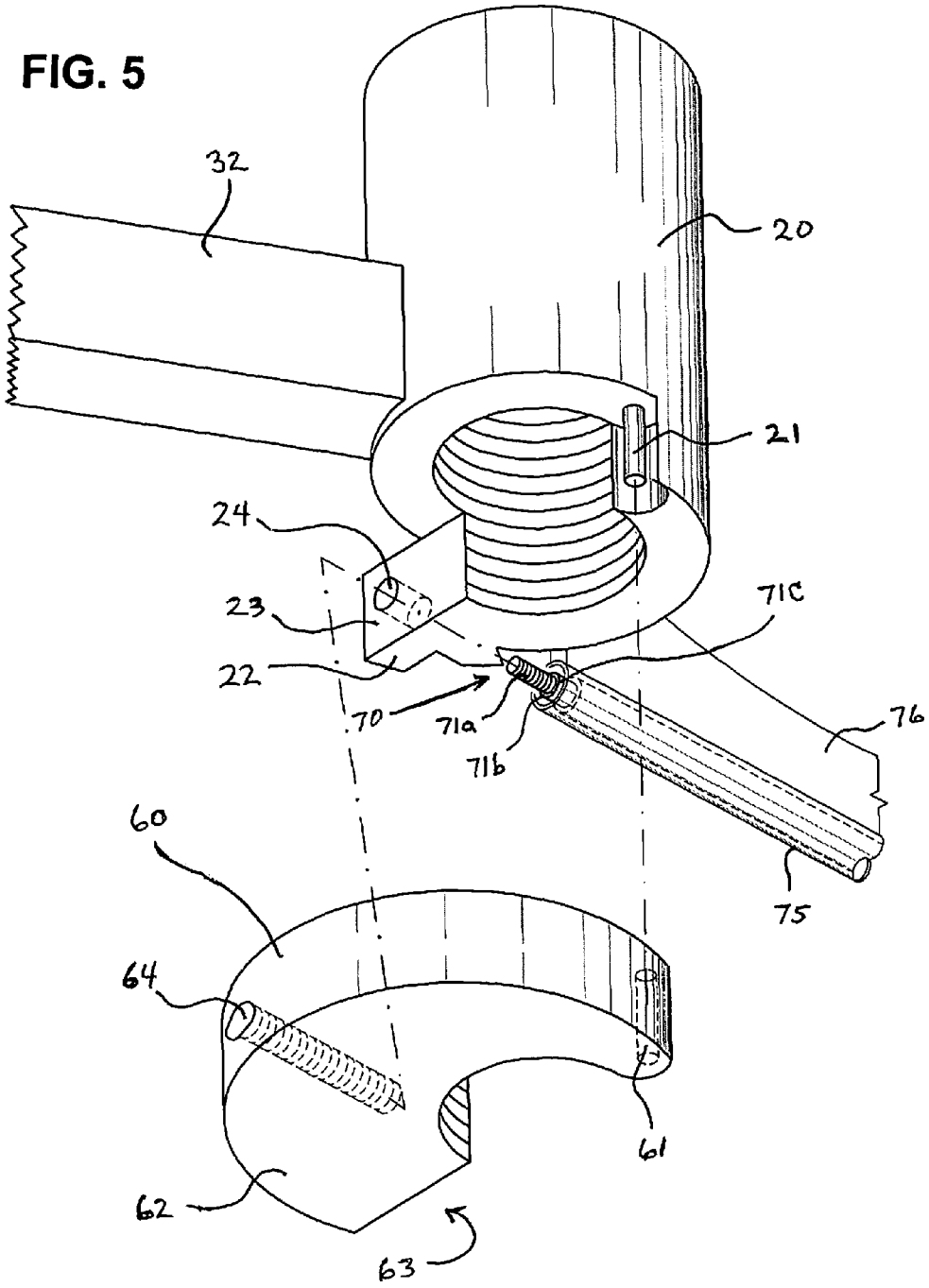
FIG. 5 is an exploded view of the post collar and clamp arm assembly of a preferred embodiment of the present invention.

FIG. 5 is an exploded view of features of a preferred embodiment including the pivoting clamp arm 60, the post collar 20 and the turnable shaft 70. Relative to the post collar, for illustration purposes, the clamp arm is depicted somewhat larger in scale and the shaft and shaft collar 75 are shown somewhat smaller in scale. The turnable shaft 70 has a threaded proximal portion 71*a* terminated distally in a shoulder portion having an increased diameter 7*c*, the increase in diameter forming a shaft shoulder 71*b*. The shaft 70 is stabilized by the shaft collar 75 which is secured by a brace 76.

The post collar 20 includes a pivot pin 21 which is received by a corresponding pivot bore 61 located in one end of the clamp arm 60. In the preferred embodiment, the clamp arm 60 includes a projection 62 at the other end of the clamp arm which includes a clamp arm face 63 and a shaft hole 64 threaded matingly to engagedly receive a sufficient part of the threaded proximal portion 71*a* of the shaft 70.

The post collar 20 has a collar protrusion 22 which includes a collar face 23 and a shaft bore 24, the shaft bore being sized sufficiently to accept the proximal portion 71*a* of the shaft and to prevent passage of the shoulder 71*b*. In the preferred embodiment, the threaded proximal portion 71*a* is 0.50 inch in diameter and is 1.5 inches long. Distally thereafter, the shaft steps up to a shoulder portion 71*c* of 0.75 inch in diameter, the change in diameter forming the shaft shoulder 71*b*. The shaft bore 24 in the preferred embodiment is 0.55 inch in diameter and is smooth. In the same preferred embodiment, the 0.75 inch diameter shoulder portion is only 0.63 inch long. The shaft distally thereafter steps up to 1.0 inch diameter for the remainder of the length of the shaft. In the preferred embodiment, the total length of the shaft is 13.5 inches.

Figure 6:
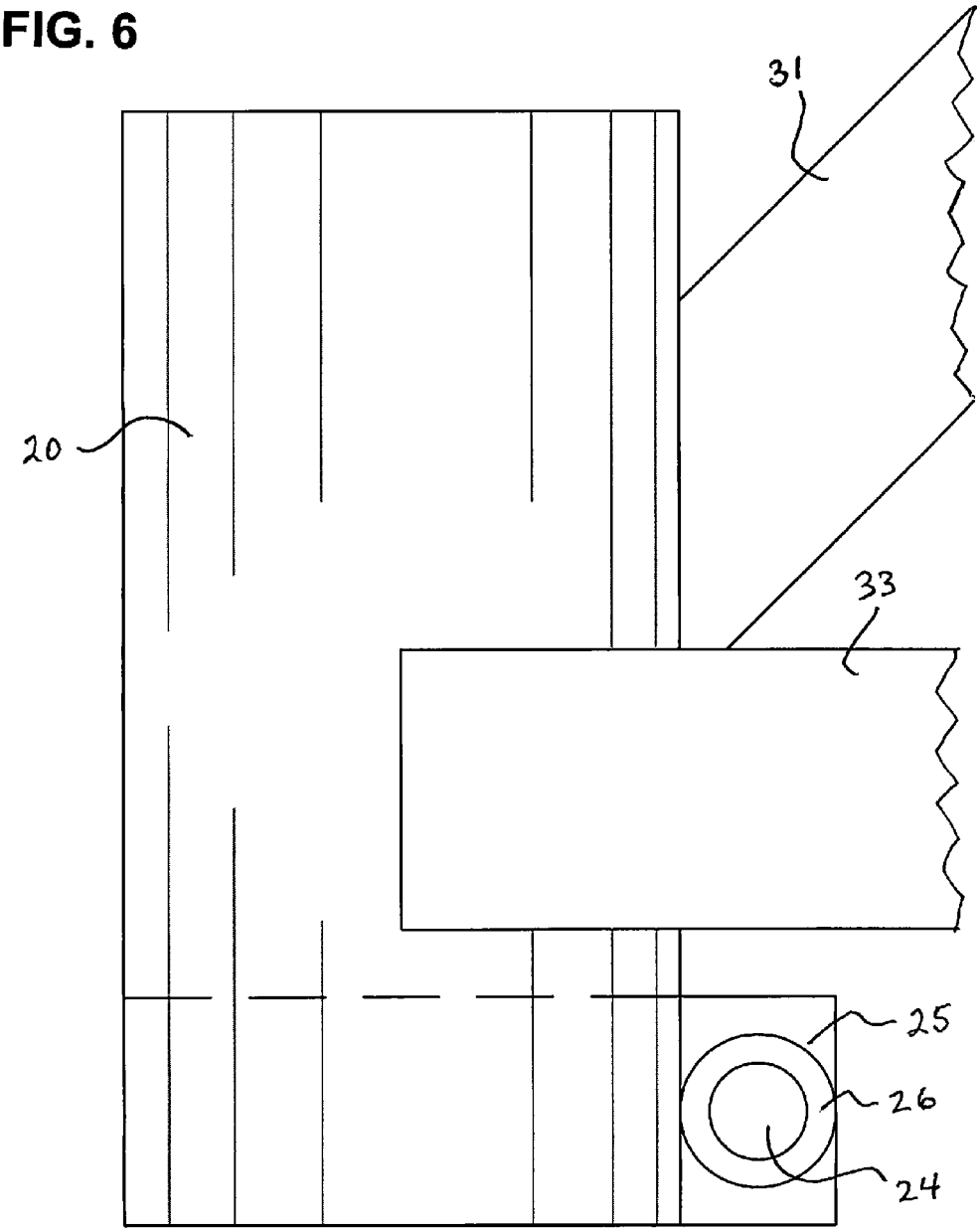
FIG. 6 is a side view of the post collar and shaft shoulder bearing surface with washer of a preferred embodiment of the present invention.

In FIG. 6 is shown features of a preferred embodiment in the absence, for illustration purposes, of the turnable shaft. FIG. 6 shows the entrance to the shaft bore 24, the rim thereof forming a shaft-shoulder bearing surface 25. An optional bearing washer 26 is provided which would communicate intermediately between the bearing surface 25 and the shaft shoulder during actuation of the clamp arm to grip the post.

Figure 7:
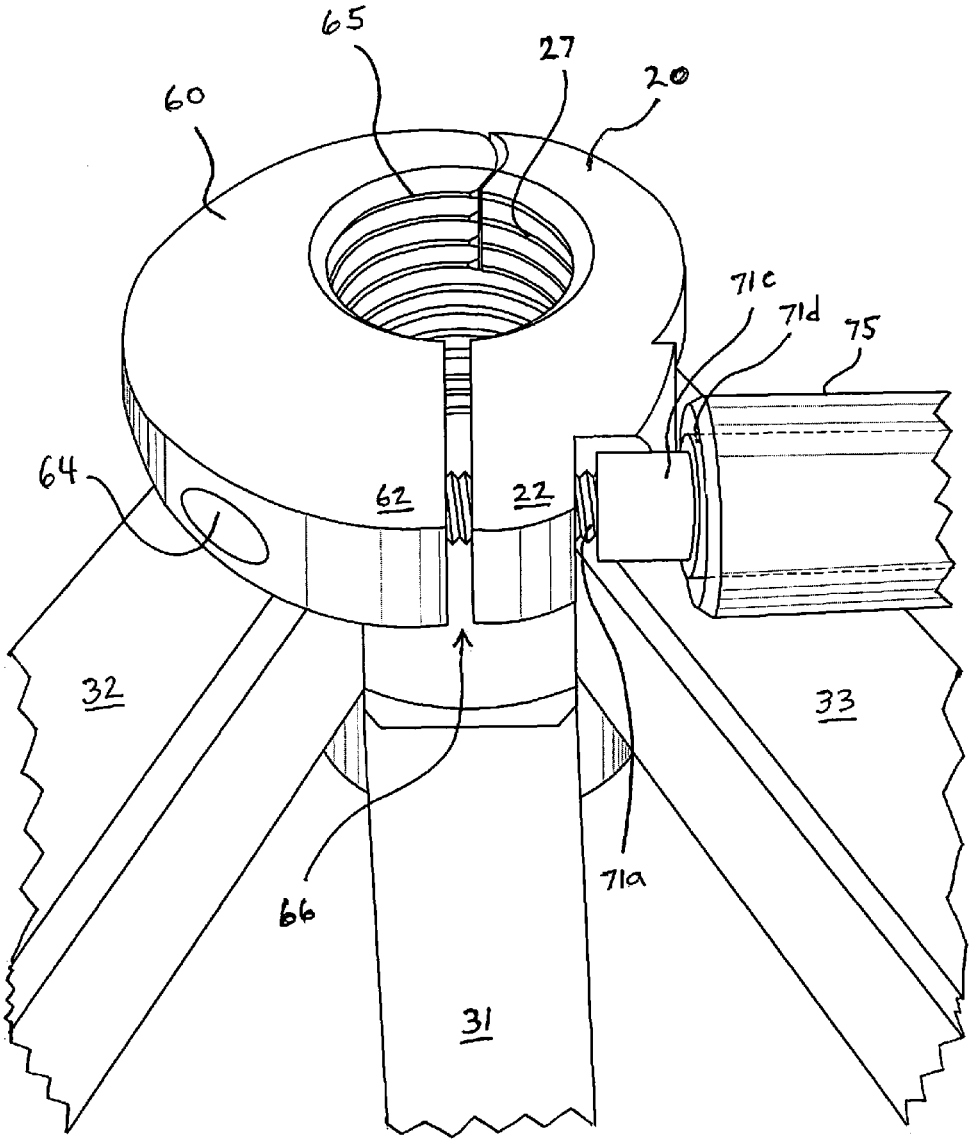
FIG. 7 is perspective view of the clamp arm and post collar assembly of a preferred embodiment of the present invention.

In FIG. 7 is shown features of a preferred embodiment of the post collar 20, clamp arm 60 and interaction of the shaft therewith as viewed from a position behind and beneath the post collar. The post collar 20 is shown having a threaded inner surface 27 and clamp arm 60 is shown having a threaded inner surface 65, both inner surfaces having equivalent axial radii and are positioned in cooperatively threaded relationship with each other forming together a nearly complete circular collar bore. In this position, the shaft bore and shaft hole 64 are axially aligned with each other and a gap 66 is provided between the clamp arm face 63 and the collar face 22 to allow space for the clamp arm 60 to pivot toward the post 15 and grip the post lightly or firmly as desired. In the preferred embodiment, when in said cooperatively threaded relationship, and utilizing a threaded post of 1.75 inches diameter and a matingly threaded post collar, the preferred gap is 0.094 of an inch.

FIG. 7 further shows a threaded proximal portion 71*a* of the shaft to have entered the shaft bore of the protrusion 22 of the post collar 20 and to have entered the shaft hole of the projection 62 of the damp arm 60. Once the threaded proximal portion is threadedly engaged with the threads of the shaft hole 64, turning of the shaft will draw the shaft shoulder against the bearing face of the protrusion 22 preventing entry of the shoulder section 71*c*. Additional turning of the shaft will narrow the gap 66 actuating the clamp arm to grip the post when the post is inserted into the post collar. The grip on the post may be loosened as desired by turning the shaft in the opposite direction.

Optionally, the shaft may be comprised, for example, of screw shaft with a head forming a shoulder such as an alien screw or other such screw as would be known of one of skill in the art. Alternatively, other clamping means as may be known in the art, such as for example, hinge clamps or double bolt clamps, may be secured to the post collar and employed to grip the post.

As one can see from the drawings and the descriptions above, the present invention substantially advances the art of speed bag apparatuses and provides an adjustable device that reduces, if not entirely eliminates, unwanted vibration during use.

Although the description above contains many details and specificities, these should not be construed as limiting the scope of the invention, but as provision of examples of some of the presently preferred embodiments of the invention. The scope of the invention should be determined by the appended claims and their legal equivalents, rather than by the examples provided.

I claim:

1. An improved speed bag apparatus comprising:

a post including a lower end;

a post collar attached to a mounting apparatus and configured to receive and guide the post within the post collar and having a clamp to selectively grip the post and maintain the post in a fixed position;

a vibration dampener having a base and a neck, the base being broader than the neck, the lower end of the post being secured to the neck; and a platform wherein the vibration dampener is secured to the platform and wherein the platform is configured to accept a speed bag attachment mechanism.

2. The speed bag apparatus of claim 1 wherein the clamp includes a clamp arm that pivots.

3. The speed bag apparatus of claim 2 wherein the apparatus includes a turnable shaft having a threaded proximal portion and a shoulder, and wherein the post collar includes a protrusion having a shaft bore selectively sized to receive the proximal portion of the shaft, the shaft bore having a rim forming a bearing surface for communication with the shoulder and wherein the clamp arm includes a projection having a shaft hole matingly threaded to receive the threads of the proximal portion of the shaft whereby turning the shaft can actuate the clamp to grip the post.

4. The speed bag apparatus of claim 3 wherein the platform includes a dampener plate and a contact board, the dampener plate being attached to the vibration dampener and the contact board being attached to the dampener plate.

5. The speed bag apparatus of claim 4 wherein the mounting apparatus includes a wall plate and at least one support member connecting the wall plate to the post collar.

6. The speed bag apparatus of claim 5 wherein the shaft is captured by a shaft collar fixed to the mounting apparatus by a brace.

7. The speed bag apparatus of claim 1 wherein the post is threaded.

8. The speed bag apparatus of claim 7 wherein the post collar has threads to mate with the threads of the post.

9. An improved speed bag apparatus comprising:

a post having a lower end;

a vibration dampener having a base and a neck, the base being broader than the neck, the lower end is secured to the neck;

a platform secured to the vibration dampener and configured to accept a speed bag attachment mechanism, wherein together the post, the vibration dampener and the platform form a first sub-assembly;

a turnable shaft, and;

a second sub-assembly comprising a post collar attached to a mounting apparatus and configured to receive and guide the post within the post collar and having a pivoting clamp arm configured to be actuated by the turnable shaft to selectively grip the post and maintain the first sub-assembly in a fixed position relative to the second sub-assembly.

10. The speed bag apparatus of claim 9 wherein the post is threaded and the lower end is unthreaded, the neck has a smooth seat to snuggably accommodate the lower end and the post collar is matingly threaded to receive the threads of the post.

11. The speed bag apparatus of claim 10 wherein the platform includes a dampener plate and a contact board and wherein the dampener plate is attached to the vibration dampener and the contact board secured to the dampener plate.

12. The speed bag apparatus of claim 11 wherein the mounting apparatus includes a wall plate and three support members connecting the post collar to the wall plate.

13. The speed bag apparatus of claim 12 wherein the vibration dampener is conical in shape.

14. The speed bag apparatus of claim 12 wherein the shaft has a handle and is captured by a shaft collar attached to a support member by a brace.

15. A method to improve a speed bag apparatus comprising:

providing a post having a lower end;

selecting a vibration dampener having a base and a neck, the base being broader than the neck;

securing the lower end of the post to the neck;

having a platform configured to accept a speed bag attachment mechanism, securing the platform to the base of the vibration dampener to form a first sub-assembly comprising the post, the vibration dampener and the platform;

providing a post collar to receive and guide the post within the post collar, the post collar having a pivoting clamp arm capable of being actuated by a turnable shaft to selectively grip the post;

attaching the post collar to a mounting apparatus, the mounting apparatus together with the post collar forming a second sub-assembly; and selecting the shaft to actuate the clamp arm.

16. The method of claim 15 wherein the post is threaded the lower end is unthreaded, the neck has a smooth seat to snuggably accommodate the lower end and the post collar is matingly threaded to receive the threads of the post.

17. The method of claim 16 wherein the platform includes a dampener plate and a contact board and wherein the dampener plate is attached to the vibration dampener and the contact board secured to the dampener plate.

18. The method of claim 17 wherein the mounting apparatus includes a wall plate and three support members connecting the post collar to the wall plate.

19. The method of claim 18 wherein the vibration dampener is conical in shape.

20. The method of claim 19 wherein the shaft has a handle and is captured by a shaft collar attached to a support member by a brace.

* * * * *